US006241781B1

(12) United States Patent
Han

(10) Patent No.: US 6,241,781 B1
(45) Date of Patent: Jun. 5, 2001

(54) WASHING MACHINE

(75) Inventor: Sang-Yong Han, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/236,316

(22) Filed: Jan. 26, 1999

(30) Foreign Application Priority Data

Feb. 18, 1998 (KR) ..... 98-5044

(51) Int. Cl.[7] ..... D06F 39/08

(52) U.S. Cl. ..... 8/159; 68/207; 68/142; 68/235

(58) Field of Search ..... 68/17.2, 23.4, 68/23.5, 23.6, 207, 142, 181 R; 8/158, 159

(56) References Cited

U.S. PATENT DOCUMENTS

| | | | | |
|---|---|---|---|---|
| 122,792 | * | 1/1872 | Wells | 68/142 |
| 292,314 | * | 1/1884 | Hollingsworth | 68/142 |
| 1,193,600 | * | 8/1916 | Patterson | 68/23.4 |
| 2,264,202 | * | 11/1941 | Forney . | |
| 2,270,750 | * | 1/1942 | Bariffi | 68/23.5 |
| 2,313,634 | * | 3/1943 | Forney . | |
| 2,629,392 | * | 2/1953 | Davis | 134/183 |
| 2,969,665 | * | 1/1961 | Saverio . | |
| 3,216,224 | * | 11/1965 | Poole | 68/23.4 |
| 3,948,064 | * | 4/1976 | Sauer et al. | 68/23.5 |
| 4,809,524 | * | 3/1989 | Sickert et al. | 68/207 |
| 4,888,965 | * | 12/1989 | Fanson et al. | 68/23.4 |
| 5,154,071 | * | 10/1992 | Singh et al. | 68/23.5 |
| 5,661,989 | * | 9/1997 | Jeon et al. | 68/23.5 |
| 5,718,130 | * | 2/1998 | Kim | 68/207 |

FOREIGN PATENT DOCUMENTS

| | | | | |
|---|---|---|---|---|
| 147499 | * | 8/1951 | (AU) | 63/23 R |
| 557091 | * | 3/1960 | (BE) | 68/23.5 |
| 383315 | * | 12/1964 | (CH) | 68/23.5 |
| 1146811 | * | 4/1963 | (DE) | 68/23.5 |
| 993216 | * | 10/1951 | (FR) | 68/142 |
| 59-131393 | * | 7/1984 | (JP) | 68/23.4 |
| 61-191398 | * | 8/1986 | (JP) | 68/207 |

* cited by examiner

*Primary Examiner*—Frankie L. Stinson
(74) *Attorney, Agent, or Firm*—Robert E. Bushnell, Esq.

(57) ABSTRACT

A washing machine including an outer tub disposed within a body of the washing machine, a rotating wash tub disposed within the outer tub for being rotated to wash and spin-dry the laundry, and a pulsator disposed on an inner bottom floor of the rotating wash tub for alternatively rotating left and right, the washing machine having a plurality of ducts mounted on a periphery of the rotating wash tub for the washing water contained in between the outer tub and the rotating wash tub to be induced and ejected into the rotating wash tub when the rotating wash tub is rotated, such that the washing water disposed in between the rotating wash tub and the outer tub is ejected into the rotating wash tub via a duct during washing and rinsing processes, thereby enhancing washing and rinsing efficiency due to formation of new water current and its collision with laundry.

22 Claims, 6 Drawing Sheets

WASHING MACHINE

CLAIM OF PRIORITY

This application makes reference to, incorporates the same herein, and claims all benefits accruing under 35 U.S.C. §119 from an application entitled Washing Machine with Spin Basket earlier filed in the Korean Industrial Property Office on Feb. 18, 1998, and there duly assigned Serial No. 5044/1998 by that Office.

BACKGROUND OF THE INVENTION

1. Field of the Invention

The present invention relates to a washing machine, and more particularly to a washing machine with a rotating wash tub mounted in an outer tub for washing and spin-dry.

2. Description of the Prior Art

Generally, a washing machine is mounted with a wash tub in an outer tub and the wash tub is disposed therein with a pulsator, where the wash tub remains stationary and only the pulsator is rotated to form a water current in the washing water for washing of laundry.

Recently, a washing machine has been developed having a rotating wash tub which rotates during washing process.

A conventional washing machine having a rotating wash tub is disposed, as illustrated in FIG. 1, with a body 1, an outer tub 3 mounted in the body 1, a rotating wash tub 5 provided in the outer tub 3 for washing and spin-dry of laundry while it is rotated, and a pulsator 7 mounted on an inner floor of the rotating wash tub 5 for generating a turbulent current in the washing water and for applying a water power to the laundry for pulsation and washing thereof.

The pulsator 7 in the conventional washing machine having a rotating wash tub thus constructed is rotated left and right in the rotating wash tub 5 while the rotating wash tub 5 is rotated to form a water current therein to perform the washing and rinsing processes.

However, there is a problem in the conventional washing machine having a rotating wash tub thus described in that formation of water current in the rotating wash tub is weak, and washing and rinsing are executed, most of the case, by the water current made by rotation of the pulsator, to thereby reduce washing and rinsing performances.

SUMMARY OF THE INVENTION

The present invention is disclosed to solve the aforementioned problems and it is an object of the present invention to provide a washing machine constructed and arranged to eject the washing water contained in between an outer tub and a rotating wash tub into the rotating wash tub to thereby improve the washing and rinsing performances.

In accordance with the object of the present invention, there is provided a washing machine including an outer tub disposed within a body of the washing machine, a rotating wash tub disposed within the outer tub for being rotated to wash and spin-dry the laundry, and a pulsator disposed on an inner bottom floor of the rotating wash tub for alternatively rotating left and right, the washing machine further having a plurality of ducts mounted on a periphery of the rotating wash tub for the washing water contained in between the outer tub and the rotating wash tub to be induced and ejected into the rotating wash tub when the rotating wash tub is rotated, where the duct is coupled along the circumferential direction of the rotating wash tub and is gradually enlarged in sectional area thereof as it goes towards an inlet thereof, the inlet of the duct formed to face oppositely to rotating direction of the rotating wash tub and an outlet thereof being coupled to a nozzle through which the washing water is ejected into an inner side of the rotating wash tub, where an ejected hole of the nozzle faces the circumferential direction or a central direction of the rotating wash tub.

It should be noted that in a washing machine having a rotating wash tub which alternatively rotates left and right, a first and a second duct, each having an inlet facing oppositely are constructed to be so coupled that the washing water existing in between an outer tub and a rotating wash tub can be always infused into the rotating wash tub regardless of rotating directions of the rotating wash tub, where, it is preferable that the first and second ducts are positioned, each at a different height in order not to obstruct the infusing water and back flow prevention unit are provided at each outlet of the first and second ducts in order to prevent the washing water from flowing backward to the outer tub through the first and second ducts when the washing water does not flow into the rotating wash tub.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Preferred embodiments of the present invention will now be described in detail with reference to the accompanying drawings.

Figure 1:
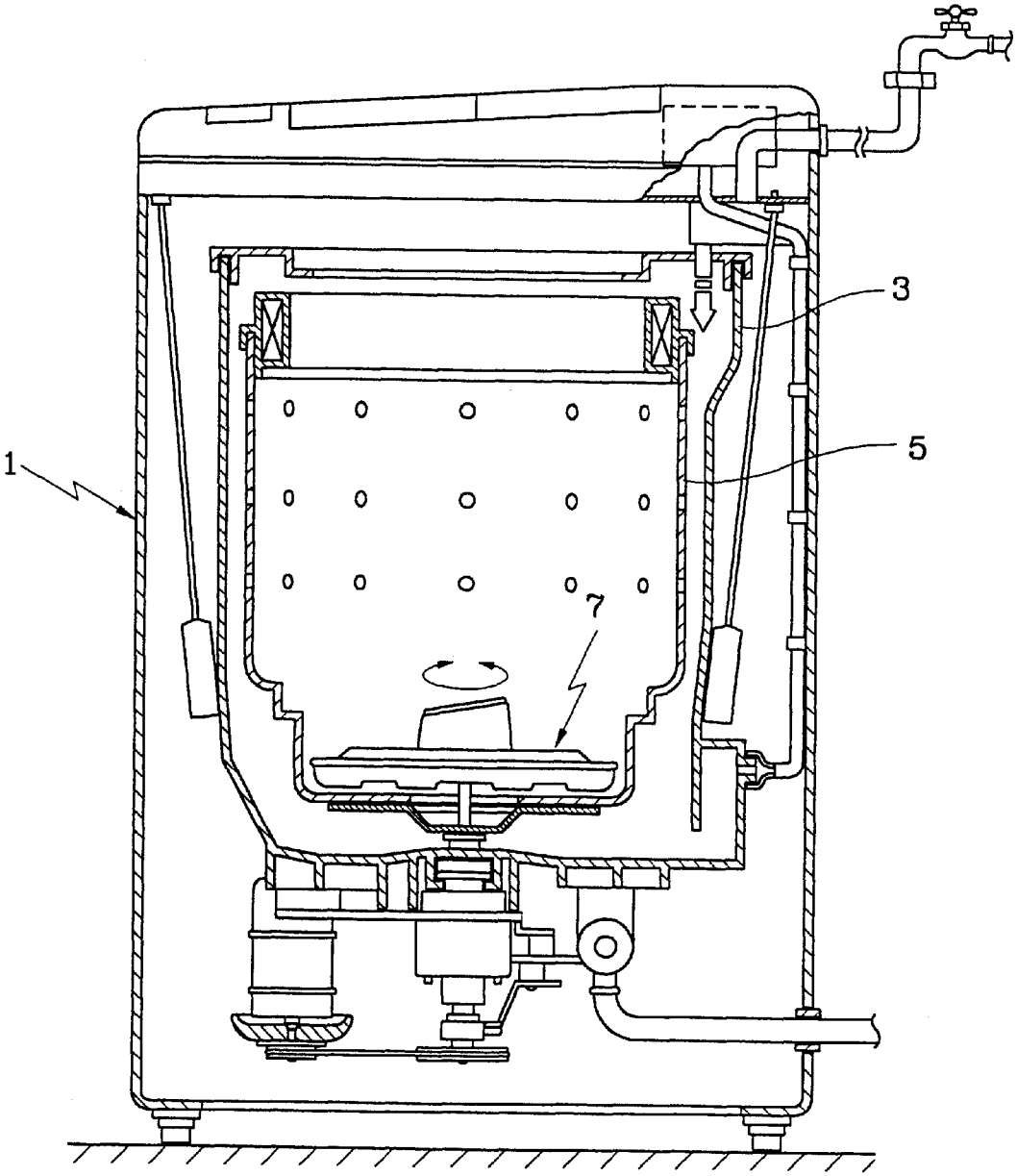
FIG.1 (PRIOR ART)
FIG. 1 is a longitudinal sectional view for illustrating a conventional washing machine having a rotating wash tub.
Figure 2:
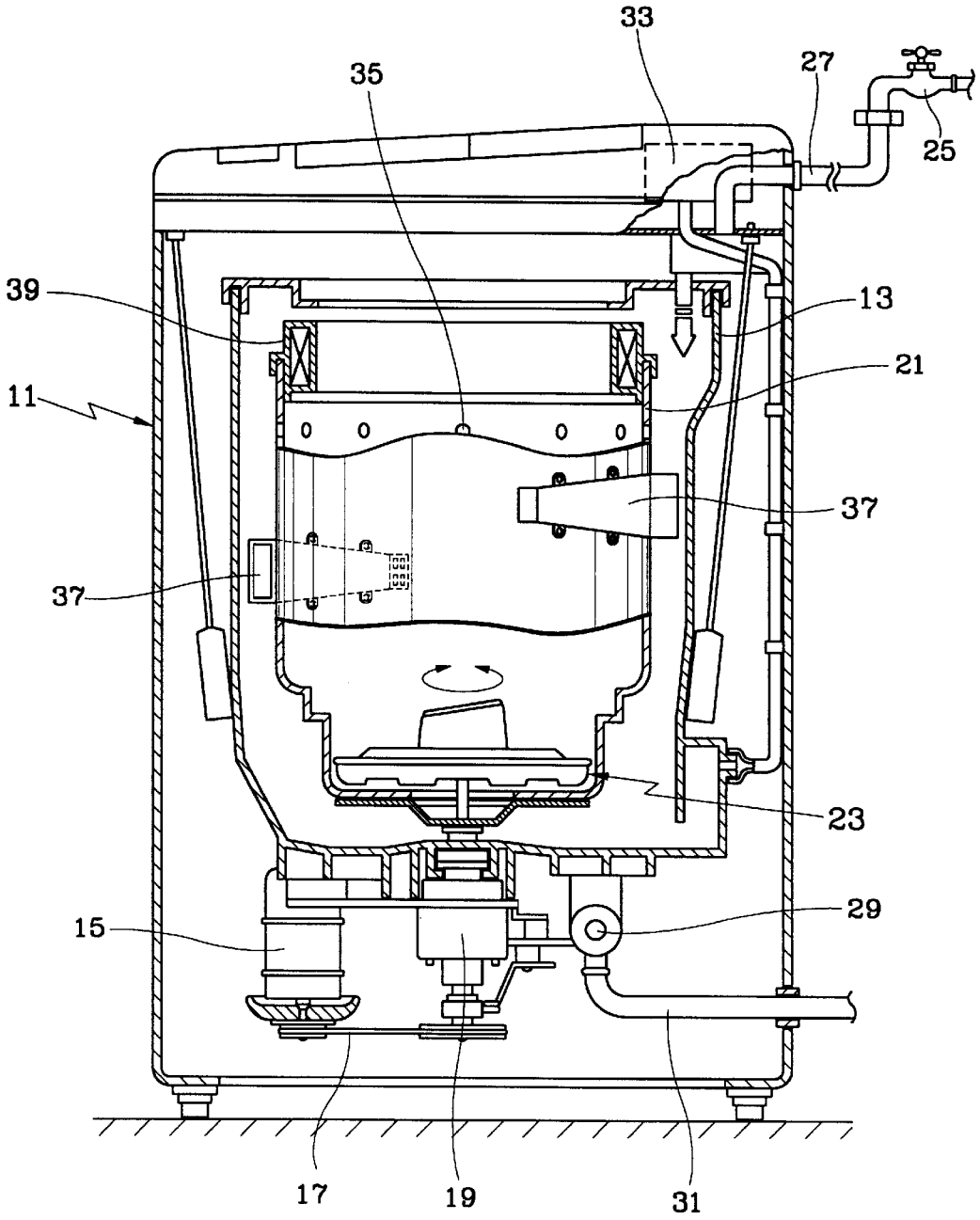
FIG. 2 is a longitudinal sectional view for illustrating a washing machine having a rotating wash tub according to a first embodiment of the present invention.

As illustrated in FIG. 2, a washing machine with a rotating wash tub according to the first embodiment of the present invention is disposed with an outer tub 13 mounted in a body 11 of the washing machine, a driving motor 15 externally mounted underneath the outer tub 13 for generating a power, a power transmission unit 19 centrally mounted underneath the outer tub 13 for being cooperatively operated by receiving the power from the driving motor 15 via a belt 17, a rotating wash tub 21 mounted in the outer tub 13 for receiving the power from the power transmission unit 19 and rotating for execution of washing and spin-dry, and a pulsator 23 arranged on the rotating wash tub 21 for alternatively rotating left and right by receiving the power from the power transmission unit 19 to make flow of the washing water turbulent and simultaneously applying a washing power to laundry for agitation and washing thereof.

Furthermore, the body 11 of the washing machine is mounted at a rear side thereof with a hose 27 so as to supply the washing water from a faucet 25 into the rotating wash tub 21. The outer tub 13 is disposed thereunder with a drainage pump 29 to drain out the washing water in the rotating wash tub 21. The drainage pump 29 is coupled to a drainage hose 31 to discharge the washing water to a drainage (not shown).

The body 11 is equipped thereon with a detergent dissolving unit 33 in order to dissolve inserted detergent by way of water and to supply the inserted detergent with the water into the outer tub 13 and the rotating wash tub 21.

The rotating wash tub 21 is formed at a circumference thereof with a plurality of holes 35 through which washing water drains into the outer tub 13, and is the rotating wash tub 21 is coupled with the washing water that drained into the outer tub 13, and the rotating wash tub 21 is coupled at a periphery thereof to a plurality of ducts 37 for ejecting the washing water into the rotating wash tub 21 and is again coupled at an upper area thereof to a balancer 39 for balancing the rotating wash tub 21 when it is rotated.

Figure 3:
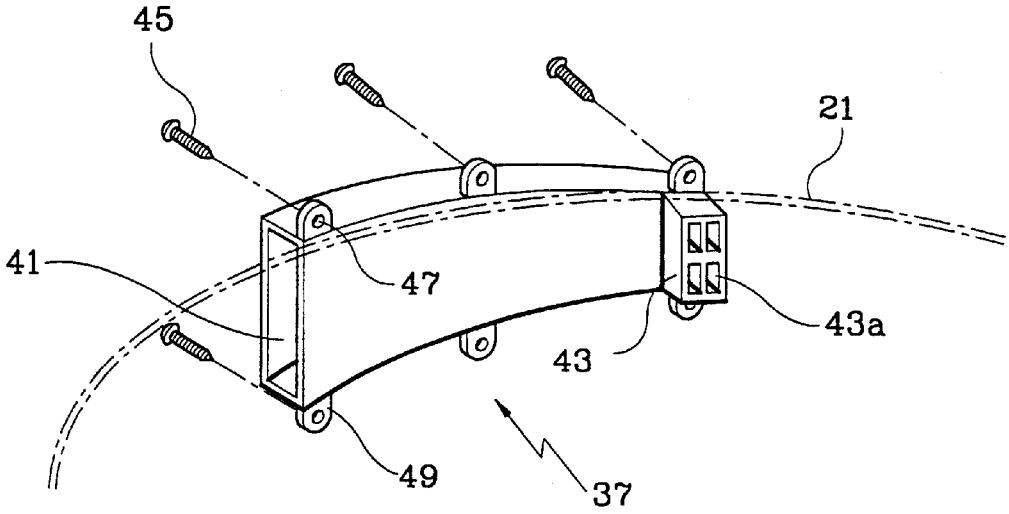
FIG. 3 is a perspective view for illustrating a duct shown in FIG. 2.

The duct 37 is, as illustrated in FIG. 3, coupled to a circumference of the rotating wash tub 21 and is enlarged in its sectional area as it goes toward an outlet 41. The duct 37 is formed at its outlet side with a nozzle 43 in order to increase an ejecting force with the rotating wash tub 21, and is also formed along a marginal area tub 21, and is also formed along a marginal area touching the rotating wash tub 21 with a plurality of flanges 49. The flange 49 is in turn disposed with a hole 47 through which fastening member 45 is to be inserted. The nozzle may be coupled to an outlet side of the duct as a separate member.

The outlet 41 of the duct is formed opposite to a rotating direction of the rotating wash tube 21 and the nozzle 43 is inwardly protruded into the rotating wash tub 21. The rotating wash tub 21 is formed with a square hole for the nozzle 43 to pass therethrough and the nozzle is formed at a sectional area thereof with a plurality of ejection holes 43*a*. The ejection hole 43*a* is arranged to centrally face the rotating wash tub 21.

Figure 4:
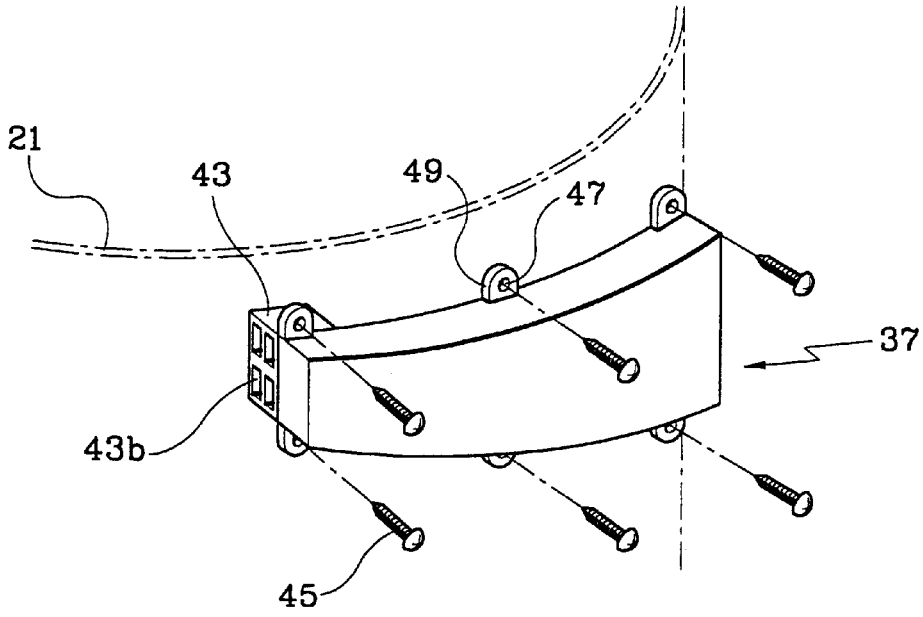
FIG. 4 is a perspective view for illustrating a duct shown in FIG. 2 according to another example of the present invention.

Meanwhile, the nozzle 43, in FIG. 4, is formed at a side sectional area thereof with ejection holes 43*b* such that the washing water infused into the duct can be ejected toward a circumferential direction of the rotary wash tub 21.

Next, the operational effect of the washing machine with the rotating wash tub will be described according to the first embodiment of the present invention thus constructed.

When a control unit (not shown) is manipulated and washing condition is selected while laundry is inserted into the rotating wash tub 21, a turning effect generated from the driving motor 15 is transmitted to the power transmission unit 19 via the belt 17, and the washing and rinsing are executed by rotation of the pulsator 23 coupled to an axle member of the power transmission unit 19 and the rotating wash tub 21. Then a spin-dry process is executed where the rotating wash tub 21 is rotated.

During wash and rinse processes, the pulsator 23 is rotated to form a water current while the rotating wash tub 21 is rotated to eject the washing water into the rotating wash tub 21 through the duct 37 which in turn generates another water current.

Figure 5:
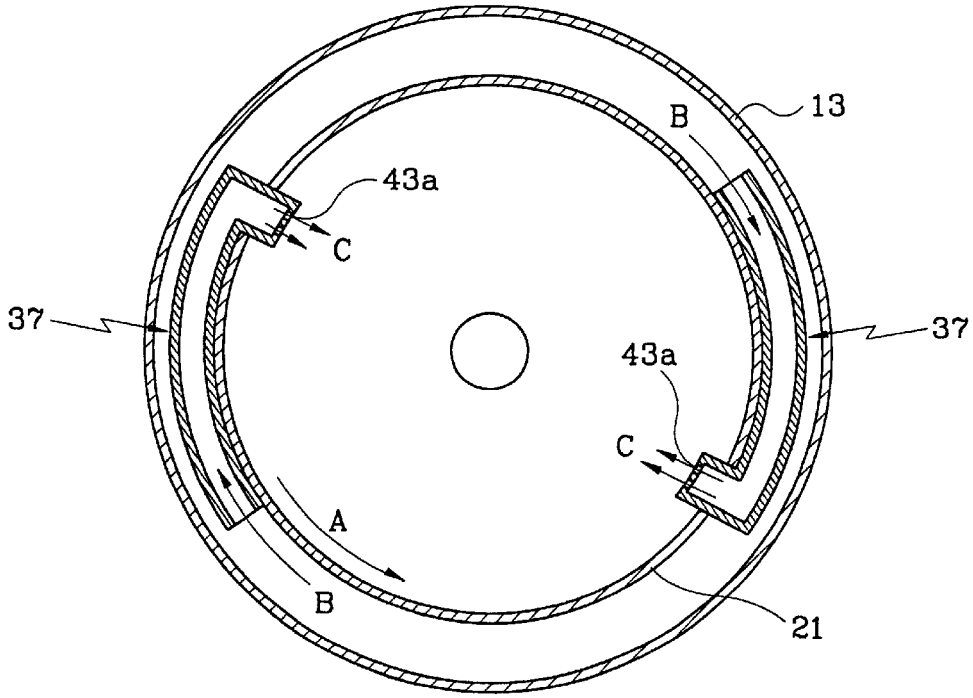
FIGS. 5 and 6 are schematic diagrams for illustrating an operation of a washing machine having a rotating wash tub according to the first embodiment of the present invention.

In other words, as illustrated in FIG. 5, when the rotating wash tub 21 is rotated in the counter-clockwise direction of an arrow (A), the washing water contained in between the outer tub 13 and the rotating wash tub 21 is infused into the duct 37 in the clockwise direction of an arrow (B), and then the washing water is ejected into a central position of the rotating wash tub 21 via the ejection holes 43*a* at the nozzle 43 in the inward direction of an arrow (C), where the washing water in between the outer tub 13 and the rotating wash tub 21 collides with the water current formed by the pulsator 23 and simultaneously hits the laundry to improve washing and rinsing efficiency.

Figure 6:
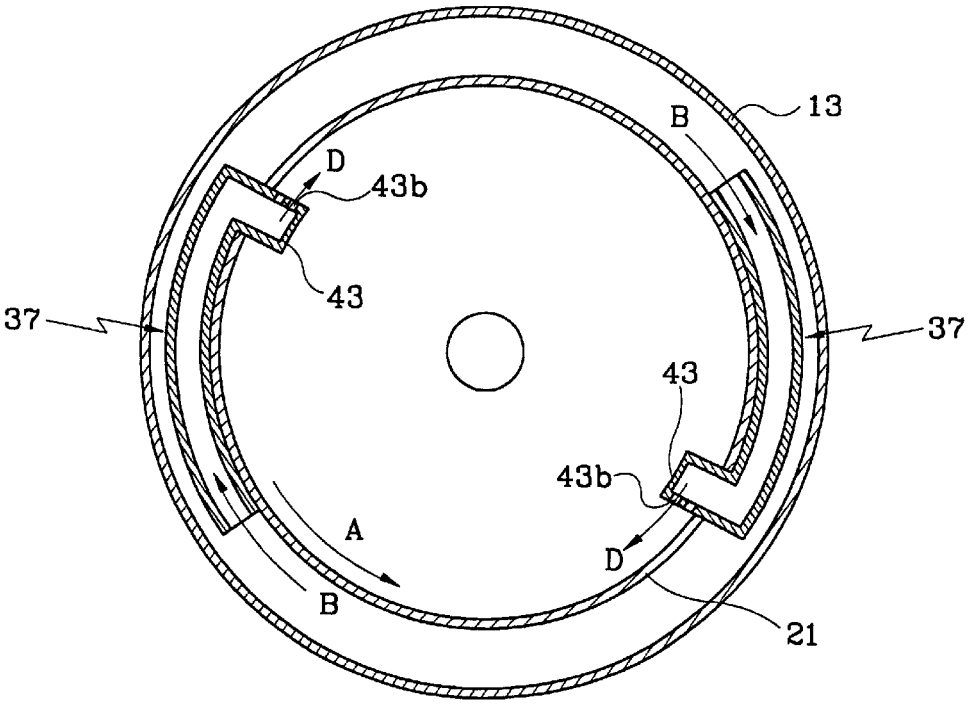

Furthermore, when the rotating wash tub 21 is rotated in the counter-clockwise direction of an arrow (A), as illustrated in FIG. 6, where the nozzle 43 is formed with the ejection holes 43*b* toward the direction of circumference of the rotating wash tub 21, the washing water in between the outer tub 13 and the rotating wash tub 21 is infused into the duct 37 in the clockwise direction of an arrow (B) to thereafter be ejected inwardly along the circumferential direction of the rotating wash tub 21 via the ejection holes 43*b* of the nozzle 43 in the clockwise direction of an arrow (D).

Figure 7:
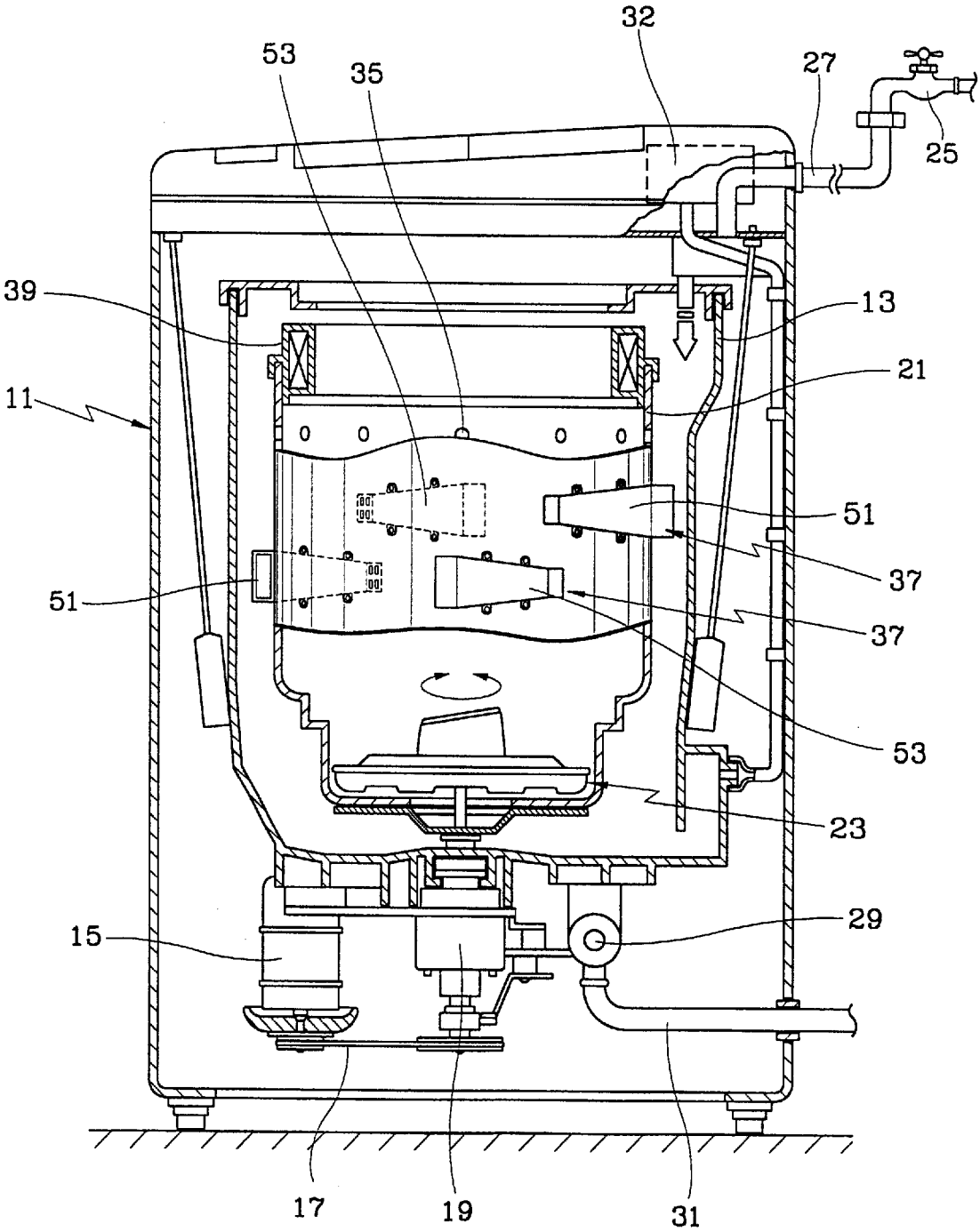
FIG. 7 is a longitudinal sectional view for illustrating a washing machine having a rotating wash tub according a second embodiment of the present invention.

FIG. 7 is a longitudinal sectional view of a washing machine having a rotating wash tub according to a second embodiment of the present invention. The second embodiment of the present invention relates a washing machine where the rotating wash tub 21 is alternatively rotated to the left and to the right like the pulsator 23 during washing and rinsing processes.

At this time, as illustrated in FIG. 7, the duct 37 includes a first duct 51 and a second duct 53, each having an inlet facing oppositely and is coupled to a periphery of the rotating wash tub 21.

According to the structure thus described, the washing water disposed in between the outer tub 13 and the rotating wash tub 21 can be infused into the rotating wash tub 21 regardless of the rotating direction of the rotating wash tub 21 to thereby enhance the washing and rinsing efficiency.

The first dust 51 and the second duct 53 are arranged at a mutually different height to prevent obstruction of infusing washing water.

Figure 9:
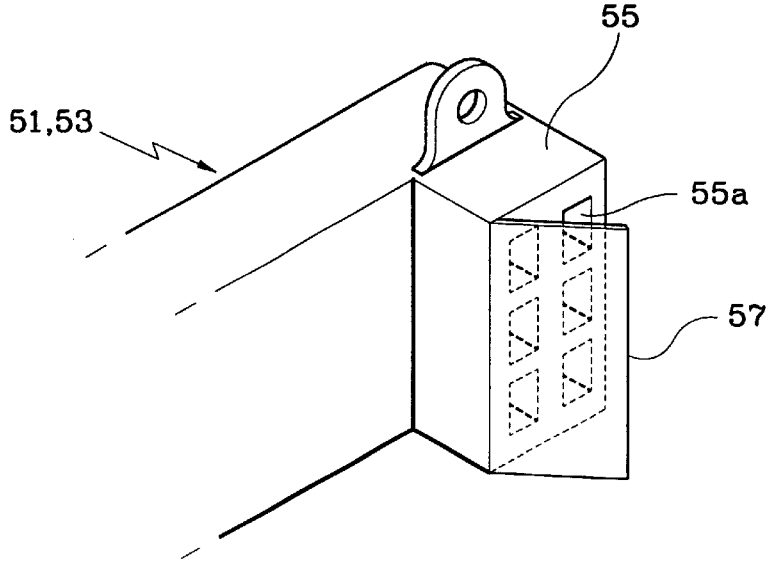
FIG. 9 is a perspective view for illustrating back flow prevention means coupled to outlet sides of the first and second ducts in FIG. 7.

Furthermore, as illustrated in FIG. 9, ejection holes 55*a* of duct 55 formed at the first and second ducts 51 and 53 are coupled to back flow prevention unit 57 in order to prevent the washing water in the rotating wash tub from back flowing to the outer tub 13 through the first duct 51 or the second duct 53 when the washing water is not infused into the rotating wash tub 21.

The back flow prevention unit 57 is a flexible damper plate which is opened or closed by force created by flow of the washing water. At this time, the back flow prevention unit 57 may be a diaphragm made of rubber.

One marginal end of the damper plate 57 is attached to one marginal line of an area formed with the ejection holes 55*a* and the other marginal line is freely positioned from the nozzle 55. The damper plate 57 may be coupled to an inner area of the nozzle 55.

Figure 8:
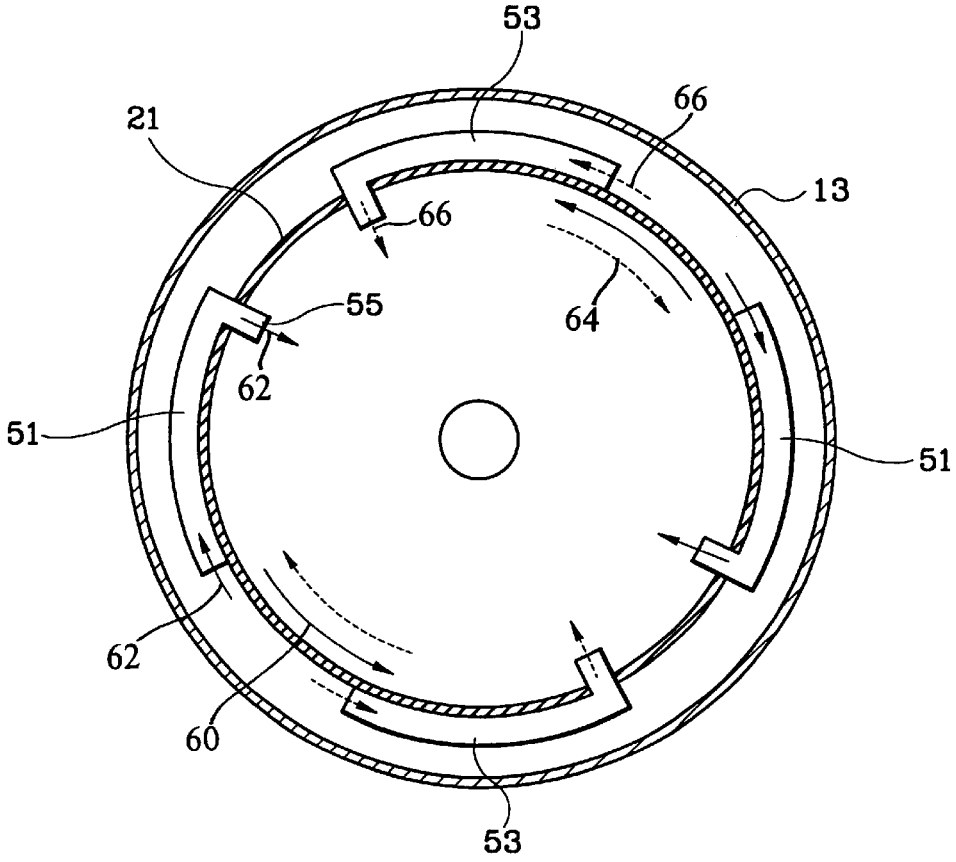
FIG. 8 is a schematic diagram for illustrating an operation of a washing machine having a rotating wash tub according to the second embodiment of the present invention.

Referring to FIG. 8, when the rotating wash tub 21 is rotated counter-clockwise 60 in a washing machine having a rotating wash tub according to the second embodiment of the present invention thus constructed, the washing water is infused into the first duct 51 in the direction of a solid arrow line 62 via the inlet of the first duct 51, pushes the damper plate and is ejected into the rotating wash tub 21 through the ejection holes 55*a,* where the washing water collides with the water current created by the pulsator 23 and at the same time hits the laundry for improved washing and rinsing efficiency. At this time, the damper plate coupled to the second duct 53 serves to close the ejection holes 55*a* to avoid back flow of the washing water through the ejection holes 55*a*.

Again referring to FIG. 8, when the rotating wash tub 21 is rotated clockwise 64, the washing water is infused into the second duct 53 via the inlet of the second duct 53 along a dotted arrow 66, pushes the damper plate and is ejected into the rotating wash tub 21 through the ejection holes 55*a,* where the washing water collides with the water current generated by the pulsator 23 and concurrently hits the laundry for enhanced washing and rinsing efficiency. At this time, ejection holes 55*a* are closed by the damper plate coupled to the first duct 51, such that now washing water is back flowed through the ejection holes 55*a*.

Furthermore, inlets of the first and second ducts are positioned at respectively different heights, such that the washing water being infused while the rotating wash tub is rotated is not mutually blocked to thereby facilitate the washing water to be infused into the first and second ducts 51 and 53. Accordingly, the washing water contained outside of the rotating wash tub is ejected inside regardless of the rotating directions of the rotating wash tub.

As apparent from the foregoing, there is an advantage in the washing machine with a rotating wash tub according to the present invention, in that the washing water disposed in between a rotating wash tub and an outer tub is ejected into the rotating wash tub via a duct during washing and rinsing processes, thereby enhancing washing and rinsing efficiency due to formation of new water current and its collision with laundry.

What is claimed is:

1. A washing machine including an outer tub disposed within a body of the washing machine, a rotating wash tub disposed within the outer tub for being rotated to wash and spin-dry laundry, and a pulsator disposed on an inner bottom floor of the rotating wash tub for alternatively rotating left and right, the washing machine further comprising a plurality of ducts mounted on a periphery of the rotating wash tub for the washing water contained in between the outer tub and the rotating wash tub to be induced and ejected into the rotating wash tub when the rotating wash tub is rotated such that new water current is formed inside the rotating wash tub.

2. The washing machine as defined in claim 1, wherein the rotating wash tub is alternatively rotated to the left and right directions.

3. The washing machine as defined in claim 1, wherein the duct is coupled along a circumference of the rotating wash tub and is formed to become enlarged in sectional area thereof as it goes toward an inlet side of the duct.

4. The washing machine as defined in claim 1, wherein the plurality of ducts are respectively disposed at different heights of the periphery of the rotating wash tub.

5. The washing machine as defined in claim 1, with each of said ducts having an inlet through the periphery of the rotating wash tub.

6. The washing machine as defined in claim 1, with the new water current being formed inside the rotating wash tub while the washing water is withdrawn from between the outer tub and the rotating wash tub and ejected into the rotating wash tub.

7. A washing machine including an outer tub disposed within a body of the washing machine, a rotating wash tub disposed within the outer tub for being rotated to wash and spin-dry laundry, and a pulsator disposed on an inner bottom floor of the rotating wash tub for alternatively rotating left and right, the washing machine further comprising a plurality of ducts mounted on a periphery of the rotating wash tub for the washing water contained in between the outer tub and the rotating wash tub to be induced and ejected into the rotating wash tub when the rotating wash tub is rotated, the inlets of the duct are oppositely formed against the rotating directions of the rotating wash tub.

8. A washing machine including an outer tub disposed within a body of the washing machine, a rotating wash tub disposed within the outer tub for being rotated to wash and spin-dry laundry, and a pulsator disposed on an inner bottom floor of the rotating wash tub for alternatively rotating left and right, the washing machine further comprising a plurality of ducts mounted on a periphery of the rotating wash tub for the washing water contained in between the outer tub and the rotating wash tub to be induced and ejected into the rotating wash tub when the rotating wash tub is rotated, the duct is coupled at an outlet thereof to a nozzle, the washing water is ejected through the nozzle into the rotating wash tub.

9. The washing machine as defined in claim 8, wherein election holes of the nozzle face a circumferential direction of the rotating wash tub.

10. The washing machine as defined in claim 8, wherein the ejection holes of the nozzle centrally face the rotating wash tub.

11. A washing machine including an outer tub disposed within a body of the washing machine, a rotating wash tub disposed within the outer tub for being rotated to wash and spin-dry laundry, and a pulsator disposed on an inner bottom floor of the rotating wash tub for alternatively rotating left and right, the washing machine further comprising a plurality of ducts mounted on a periphery of the rotating wash tub for the washing water contained in between the outer tub and the rotating wash tub to be induced and ejected into the rotating wash tub when the rotating wash tub is rotated, the rotating wash tub is alternatively rotated to the left and right directions, the duct comprises first and second ducts each having an inlet facing oppositely such that the washing water disposed in between the outer tub and the rotating wash tub can be always infused into the rotating wash tub regardless of the rotating directions of the rotating wash tub.

12. The washing machine as defined in claim 11, wherein the first and second ducts are respectively disposed at different heights in order not to block infusing washing water.

13. The washing machine as defined in claim 11, wherein the first and second ducts are disposed at outlet sides thereof with a back flow prevention unit in order to prevent the washing water in the rotating wash tub from back flowing through the first and second ducts when the washing water is not infused into the rotating wash tub.

14. The washing machine as defined in claim 13, wherein the back flow prevention unit is a damper plate, the damper plate is opened and closed by pressure of the washing water.

15. A method, comprising the inducing and ejecting washing water through a plurality of ducts mounted on a periphery of a rotating wash tub accommodating the washing water contained in between an outer tub and the rotating wash tub, inducing and ejecting the washing water into a rotating wash tub when the rotating wash tub is rotated, the washing water being used to clean laundry in a washing machine, the washing machine including the outer tub being within a body of the washing machine, a rotating wash tub being within the outer tub accommodating rotation to wash and spin-dry the laundry, and a pulsator disposed in the body of the washing machine.

16. The method of claim 15, with the inducing and ejecting of the washing water forming new water current inside the rotating wash tub.

17. The method of claim 16, with the duct being coupled along a circumference of the rotating wash tub and being formed to become enlarged in a sectional area as it goes toward an inlet side of the duct.

18. The method of claim 16, with the inlets of the duct being oppositely formed against the rotating directions of the rotating wash tub.

19. The method of claim 16, with the duct being coupled at an outlet of the duct to a nozzle, the washing water being ejected through the nozzle into the rotating wash tub.

20. The method of claim 19, with the ejection holes of the nozzle facing a circumferential direction of the rotating wash tub.

21. The method of claim 19, with the ejection holes of the nozzle centrally facing the rotating wash tub.

22. The method of claim 16, with the duct comprising first and second ducts each having an inlet facing oppositely such that the washing water disposed in between the outer tub and the rotating wash tub can be infused into the rotating wash tub regardless of the rotating directions of the rotating wash tub.

* * * * *